US007048459B2

(12) United States Patent
Bedhome et al.

(10) Patent No.: US 7,048,459 B2
(45) Date of Patent: May 23, 2006

(54) LIQUID INK WRITING INSTRUMENT WITH A SHAPE MEMORY VALVE

(75) Inventors: Vincent Bedhome, Desvres (FR); José Duez, Seldkirch (FR); Didier Lange, St. Leonard (FR)

(73) Assignee: Conte, Sur Mer (FR)

( * ) Notice: Subject to any disclaimer, the term of this patent is extended or adjusted under 35 U.S.C. 154(b) by 482 days.

(21) Appl. No.: 10/628,075

(22) Filed: Jul. 25, 2003

(65) Prior Publication Data

US 2004/0170466 A1 Sep. 2, 2004

Related U.S. Application Data

(63) Continuation of application No. PCT/FR02/00319, filed on Jan. 25, 2002.

(51) Int. Cl.
*B43K 5/00* (2006.01)

(52) U.S. Cl. ..... 401/151; 401/184; 401/186; 401/192; 401/198; 401/199; 401/205

(58) Field of Classification Search ..... 401/151, 401/183, 184, 186, 192, 198, 199, 205, 206, 401/219, 223, 232
See application file for complete search history.

(56) References Cited

U.S. PATENT DOCUMENTS 4,973,180 A * 11/1990 Hori ..... 401/141
6,164,858 A * 12/2000 Kaufmann ..... 401/205

FOREIGN PATENT DOCUMENTS

| | | |
|---|---|---|
| EP | 0 240 994 A1 | 4/1987 |
| EP | 0 516 538 A1 | 5/1992 |
| JP | 10235273 | 2/1998 |

* cited by examiner

*Primary Examiner*—Steven O. Douglas
*Assistant Examiner*—Peter deVore
(74) *Attorney, Agent, or Firm*—Jones Day

(57) ABSTRACT

The liquid ink writing instrument has a body containing, from its rear end towards its front end, a reservoir for the ink and a front chamber containing a capillary element for transferring ink coming from the reservoir to a writing head. The front chamber communicates with ambient air. The writing head is fed with ink by the capillary element, and projects from the front portion of the body. The reservoir is separated from the front chamber by a flexible wall having shape memory and provided with slots. The flexible wall acts as a valve suitable for opening when the ratio of the pressure inside the reservoir over the pressure inside the volume of the front chamber facing the valve exceeds a first value, and of reclosing instantly as soon as the ratio becomes less than or equal to a second value, the valve releasing the ink in the form of a jet directed towards the rear face of the capillary element. The first value of the ratio of the pressures is preferably about 1.07, and the second value of the ratio is preferably about 1.05. The writing instrument includes means for pressurizing the reservoir.

15 Claims, 2 Drawing Sheets

LIQUID INK WRITING INSTRUMENT WITH A SHAPE MEMORY VALVE

CROSS-REFERENCE TO RELATED APPLICATIONS

This application is a continuation of PCT Application No. PCT/FR02/00319, filed on Jan. 25, 2002, which claims priority to French Patent Application 0101125, filed on Jan. 26, 2001. The entire contents of these two applications is expressly incorporated herein by reference.

FIELD OF THE INVENTION

The present invention relates to a writing instrument having ink in the liquid state contained in a reservoir-forming chamber, the instrument having a writing head connected to a capillary element which transfers the ink from the reservoir to the writing head. The writing head can be constituted by the end of the capillary transfer element.

BACKGROUND OF THE INVENTION

Liquid ink writing instruments exist in two categories. In the first category, the reservoir which contains the ink is isolated from ambient air and does not contain air; a flexible piston moves in the reservoir as the ink is consumed and provides sealing.

In writing instruments of the second category, the reservoir which contains the ink is not isolated from ambient air; in particular, the capillary element penetrates into the ink reservoir so that ink is fed continuously to the writing head. When the writing instrument is in use, the ink which is deposited on the medium is replaced as it is consumed by ink from the reservoir diffusing into the capillary element and thence to the writing head, with the ink which leaves the reservoir being replaced by air which passes through the porous capillary element. If conditions of use change, and, in particular, if the pressure of the air contained in the reservoir changes due to a rise in air temperature, then an abnormal amount of ink flows into the capillary transfer element and can give rise to blots or smudging when the cap is taken off the instrument. To avoid that phenomenon, that type of instrument is fitted with a member generally referred to as a "buffer reservoir" having the function of absorbing excess ink coming from the reservoir before it reaches the writing head, and once normal conditions are re-established, for returning the ink it contains to the capillary element. One such writing instrument is disclosed in particular in document EP 0 516 538.

In instruments of the first category, the transfer of ink from the ink reservoir to the writing head is not continuous. This transfer takes place progressively as ink is consumed by the writing head while the instrument is in use due to the difference in pressure that such consumption of ink generates inside the body of the instrument. One such solution is known in particular from document EP 0 240 994, related to U.S. Pat. No. 4,973,180, which implements a valve mechanism that is interposed between the main ink reservoir and a secondary ink reservoir into which the capillary element penetrates. The valve mechanism may comprise, in particular, a diaphragm of elastic material such as a silicone rubber, the diaphragm being provided with a slot such that when a predetermined pressure difference acts on said diaphragm, the slot opens and ink is fed from the main reservoir to the secondary reservoir. In operation, while the instrument is in use, the consumption which occurs of the ink in the capillary element causes the pressure in the secondary reservoir to be reduced, thereby causing the valve to be opened, with ink flowing into the secondary reservoir and the capillary element being resupplied with ink. To achieve such operation, it will be understood that the pressure difference enabling the valve to be opened is relatively small. In document EP 0 240 994 which describes such an instrument, the pressure difference is said to be of the order of 125 millimeters (mm) of water column. It should be emphasized that in instruments of that type, the problem of air in the main reservoir heating does not arise since the main ink-containing reservoir is isolated from ambient air and does not contain any air, having a flexible piston which moves inside the reservoir as the ink is consumed. The presence of such a flexible piston makes such an instrument complex to manufacture.

It therefore would be desirable to provide a liquid ink writing instrument which does not have the flexible piston of document EP 0 240 994 and which is not necessarily fitted with a buffer reservoir as described in document EP 0 516 538.

SUMMARY OF THE INVENTION

The writing instrument of the present invention, in conventional manner, is a liquid ink writing instrument whose body contains, from its rear end towards its front end, a reservoir for ink or writing medium (hereinafter "ink" for the sake of convenience and without intent to limit) and a front chamber containing a capillary element for transferring ink coming from the reservoir to a writing head, which head is fed with ink by the capillary element and projects from the front portion of the body.

In a manner characteristic of the invention, the reservoir is separated from the front chamber by a flexible wall having shape memory and provided with slots. The flexible wall acts as a valve suitable for opening when the ratio (A) of the pressure ($P_1$) inside the reservoir over the pressure ($P_2$) inside the volume of the front chamber facing said valve exceeds a first value ($A_1$), and of reclosing instantly as soon as said ratio (A) becomes less than or equal to a second value ($A_2$). The valve releases the ink in the form of a jet directed towards the rear face of the capillary element. In addition, the implement includes means for pressurizing the reservoir, and the front chamber communicates with ambient air.

Thus, the valve does not operate automatically merely because of ink being consumed by the instrument being used, as in document EP 0 240 994. It is necessary to actuate the pressurizing means in order to renew the ink in the capillary element. This pressurizing must be implemented by the user on observing that the quantity of ink deposited on the medium while the instrument is in use is decreasing.

It should be observed that the first and second values ($A_1$ and $A_2$) are functions of the structure of the valve, and in particular of the material used and the size of the slot.

In a preferred embodiment, the first value ($A_1$) of the ratio (A) is about 1.07, and the second value ($A_2$) of the ratio (A) is about 1.05.

It should also be observed that at least the first value ($A_1$) need not be fixed for a given valve but may also depend on the volume of air present in the reservoir. The greater the extent to which the reservoir is empty of ink, the higher the value to which the first value ($A_1$) can rise.

Preferably, the pressurizing means are constituted by an elastically deformable zone of the body of the instrument in register with the ink reservoir. This zone may be formed by an elastomer diaphragm tensioned over a rigid portion of the body of the instrument. Advantageously it is a side zone.

The deformation capacity and the area of said zone are determined so that during unit actuation by the user a given quantity of ink is released, which quantity preferably lies in the range 0.1 cubic centimeters ($cm^3$) to 1 $cm^3$.

This preferred embodiment with an elastomer diaphragm makes it possible to provide an instrument that is very simple in structure. Nevertheless, it is possible to envisage implementing other types of pressurizing means, such as a piston placed at the rear end of the body of the instrument.

It may be preferable for the body of the instrument to be made of a material that is transparent or translucent so as to enable the user to see how much ink remains in the reservoir, and also to assess, by the intensity of the color of the capillary element, whether there still remains much ink in said capillary element and whether or not it is time to implement the pressurizing means. Spraying the ink in the form of a jet can lead to the inside wall of the front chamber being dirtied, thus preventing good viewing. Thus, according to another characteristic of the invention, the capillary element has an ink-receiving rear face which is suitable for absorbing the quantity of ink that is released when the valve is opened. In this particular disposition, the rear face of the capillary element serves to collect the ink jet sprayed from the valve. Advantageously, this face is concave in shape, thus enabling the surface area that comes into contact with the ink to be increased compared with a plane surface. Under such circumstances, the peripheral edge of said concave surface is in the immediate vicinity of the peripheral edge of the valve so that as little ink as possible can escape, regardless of the vertical, horizontal, or sloping position that the instrument might be occupying when pressurized.

It is also possible to place a transparent hollow tube having shape memory in the front chamber so that the upstream end of the tube is in line with the flexible wall, the tube acting as a valve and having its downstream end opening out in the capillary element. The ink jet coming from the valve and channeled inside the tube is clearly visible to the user; in addition, the quantity of ink as injected in this way remains in the tube until it has been completely absorbed by the capillary element. Absorption speed slows down as the capillary element becomes saturated in ink. This gives the user a visible indication as to whether it is necessary to continue or to stop actuating the pressurizing means depending on the shorter or longer presence of liquid ink in the tube.

The capillary element may constitute the rear portion of the writing head. In a variant embodiment, the rear portion of the capillary element is engaged in the downstream end of the tube. Under such circumstances, the tube can serve as a member for holding the writing head.

Communication between the front chamber and ambient air can make it necessary for the tube to be pierced by a communication hole, preferably near its upstream end, close to the flexible wall acting as a valve.

The fact that it is the user who causes the capillary element, and thus also the writing head, to be fed with ink can lead to a difficulty, in particular when the instrument is made available to children. If the pressurizing means are actuated frequently while the capillary element is not completely nor even partially empty of ink, then the capillary element will become saturated and ink will flow into the front chamber. Such situation runs the risk of causing ink to run out through the writing head, since the ink is no longer absorbed by the capillary element. To limit that drawback, according to another characteristic of the invention, means are provided which act in the event of the portion of the capillary element facing the valve becoming saturated with ink to hermetically close said rear portion of the front chamber, and to reduce the volume of said rear portion. Any further actuation of the pressurizing means will create excess pressure in said rear portion of the front chamber, and as a result it becomes more and more difficult for the user to actuate the pressurizing means in order to open the valve and eject a new quantity of ink.

BRIEF DESCRIPTION OF THE DRAWINGS

The present invention will be better understood on reading the following description of a preferred embodiment of a liquid ink writing instrument having a shape memory valve, shown in the accompanying drawings, in which.

MORE DETAILED DESCRIPTION

The writing instrument described below constitutes an instrument of the kind in which ink is in the liquid state in a reservoir that contains air.

Figure 1:
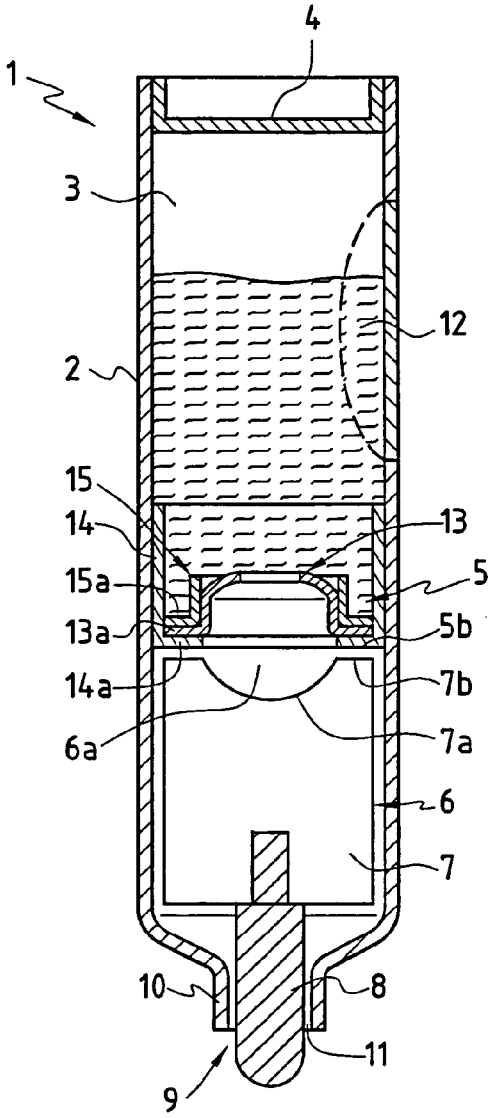
FIG. 1 is a longitudinal section view of a first embodiment of the instrument.
Figure 2:
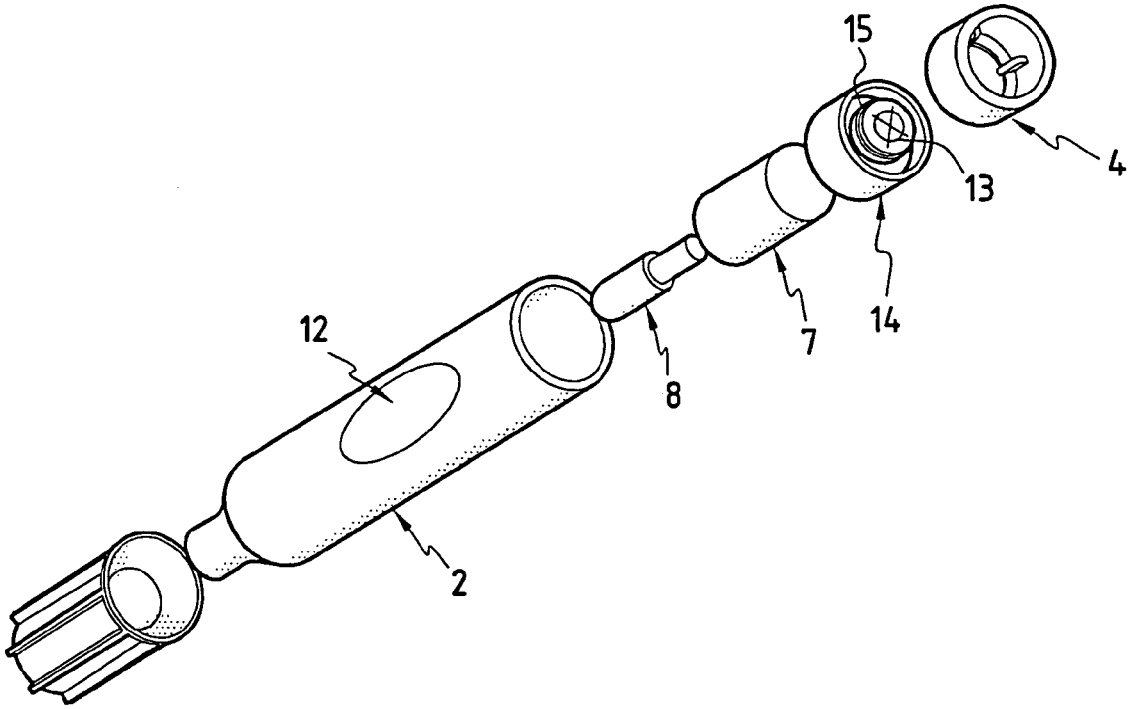
FIG. 2 is a diagrammatic perspective view of the various elements making up the FIG. 1 instrument.
Figure 3:
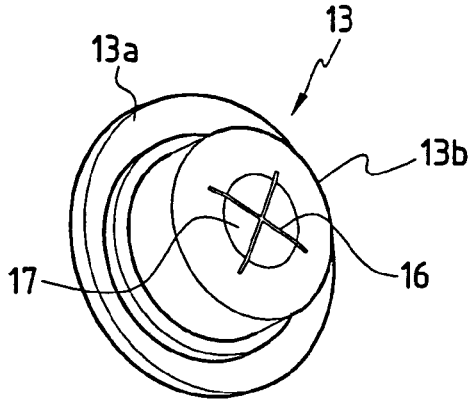
FIG. 3 is a perspective view of the shape memory valve used in the instrument of FIGS. 1 and 2.

More precisely, in the first embodiment shown in FIGS. 1 to 3, the writing instrument 1 comprises a body 2 of generally cylindrical overall shape, having from its rear end towards its front end: a first internal chamber acting as a reservoir 3 for the ink, said chamber being defined towards its rear end by a closure plug 4 and towards its front end by a valve mechanism 5; and in the body 2 of the instrument 1, beyond the reservoir 3, a front chamber 6 containing in succession a capillary element 7 and a writing head 8, the writing head 8 projecting to the outside through a central opening 9. The function of the capillary element 7 is to transfer liquid ink coming from the reservoir 3 to the writing head 8.

The front chamber 6 is in communication with ambient air via an orifice 11 which, in the example shown, is made through the portion 10 extending or constituting the front end of the body 2 and acting as a carrier for the writing head.

In the example shown, the body 2 of the instrument is a rigid piece of plastics material that is inert to solvents, and that is completely or partially transparent or translucent so as to enable the user to see the level of ink that is to be found in the reservoir 3, and also the coloring of the capillary reservoir 7 which provides temporary storage of ink in the front chamber 6.

In characteristic manner, the instrument 1 has means for pressurizing the air in the reservoir 3. The pressurizing means, in the example shown, are constituted by an elastomer diaphragm 12 replacing a rigid portion of the body 2 locally in the rear portion thereof, in register with the reservoir 3. This elastomer diaphragm 12 is naturally elastically deformable and can be actuated manually by the user. More precisely, by exerting pressure on the diaphragm 12, the user deforms it, pushing it towards the inside of the tank 3, thereby reducing the volume of the tank 3 and increasing the pressure of the air contained therein, thus causing the valve 13 of the valve mechanism 5 to open, provided the increase in pressure is sufficient.

The valve mechanism 5 comprises a shape memory valve 13 which is selected so as to open instantly as soon as the upstream pressure, i.e., the pressure in the reservoir 3, exceeds a certain fraction of the downstream pressure, i.e., the pressure in the rear portion 6*a* of the front chamber 6, which rear portion lies between the capillary embodiment 7 and the valve 13. In addition, this valve 13 is designed to reclose instantly as soon as the upstream pressure becomes less than or equal to some other fraction of the downstream pressure. Thus, minor and involuntary deformation of the diaphragm 12 is unlikely to cause the valve 13 to open. It is essential for the user to apply voluntary action in order to achieve the pressure required for such opening.

It should be observed that ink being consumed by the writing head 8 while the instrument is in use does not reduce the pressure in the front chamber 6 since this chamber is in communication with ambient air via the communication orifice 11. Thus, in the simplest version, the pressure P2 that exists in the rear portion 6*a* of the front chamber 6 is itself equal to atmospheric pressure.

The capillary element 7 constitutes an intermediate ink reservoir which, on its own, should enable the instrument to be used continuously over some predetermined length, for example 10 meters (m) to 15 m. It can be constituted by a fiber type reservoir of a kind that is well known in the art. It can also be constituted by a microporous reservoir obtained by sintering hydrophilic microbeads.

In the example shown, the rear face 7*a* of the capillary element 7 is concave in shape in its zone facing the valve 13, the peripheral edge 7*b* of said concave portion 7*a* being in the immediate vicinity of the peripheral edge 5*b* of the valve mechanism 5. The purpose of these structural constraints is to form in the capillary element 7 a kind of receptacle for the ink which is sprayed when the valve 13 opens, without such spraying causing the inside wall of the body 2 to become dirtied in the front chamber 6.

Air normally circulates within the entire front chamber 6, including between the rear portion 6*a* of said chamber and the communication orifice 11. This circulation can be obtained either by means of a space between the capillary element 7 and the inside wall of the body 2 of the instrument, or else possibly because of the porosity of the capillary element itself when it is designed to come into contact with the inside wall of the body 2. Because of this circulation of air, the ink which is sprayed out from the reservoir 3 can be replaced therein by air coming from the front chamber when the valve 13 is opened.

An embodiment of the writing instrument of the invention serves to limit the risk of ink running out through the writing head 8 in the event of the user manipulating the pressurizing means excessively. The drawback of the instrument 1 as described above is that in the event of the capillary element 7 being saturated, it is no longer capable of absorbing the liquid ink that is sprayed when the diaphragm 12 is actuated, so excess liquid ink can flow freely within the front chamber 6 and run out via the writing head 8. The solution to this difficulty lies in producing a temporary increase in the pressure inside the rear portion 6*a* of the front chamber 6 in the event of the capillary element 7 becoming saturated, at least in its own rear portion. This increase in the pressure $P_2$ will have the effect of requiring an even higher pressure $P_1$ in absolute terms to be applied in order to open the valve 13. As a result the user will feel resistance when actuating the diaphragm, with this indicating that it is appropriate to cease actuating it for the purpose of opening the valve 13.

To obtain this temporary increase in the pressure $P_2$ in the rear portion 6*a* of the front chamber 6, it is necessary and sufficient to cause the rear portion 6*a* to be sealed substantially hermetically relative to the remainder of the chamber 6 so as to prevent air from circulating in the rear portion 6*a*, and, in addition, to reduce the inside volume of the rear portion 6*a*, e.g., by using a material that swells on absorbing a larger quantity of liquid, either to constitute the capillary element or else in addition thereto in the inside volume of the rear portion 6*a*.

In the example shown, the writing head 8 is a part that is independent from the capillary element 7. The invention is not restricted thereto. The writing head could be constituted by the front portion of the capillary element, which would then be of a configuration and a shape adapted accordingly as a function of the intended application of the instrument.

In the valve mechanism 5, the valve proper 13 is made of a flexible material having shape memory and is held in place inside the body 2 of the instrument 1 by two pieces 14 and 15. The first piece 14 is cylindrical and presents an inwardly-directed shoulder 14*a* which serves as a seat for the peripheral rim 13*a* of the valve 13. The second piece 15 is also cylindrical and presents an outwardly-directed shoulder 15*a* dimensioned so as to slide inside the first piece 14 and to come into abutment against the peripheral rim 13*a* of the valve 13 so that the peripheral rim 13*a* is pinched between the two shoulders 14*a* and 15*a*. In the embodiment shown in FIG. 3, the valve 13 is proud relative to its peripheral rim 13*a* so as to form a kind of cup, with the convex top 13*b* being directed towards the inside of the reservoir 3 and having two mutually perpendicular slots 16. Because of the shape memory material used to make this valve 13, and because of the curvature of the top 13*b* of said valve, the two slots 16 remain closed in the normal position, thereby closing the reservoir 3 in leaktight manner. However, when the reservoir 3 is pressurized by actuating the diaphragm 12, this extra pressure pushes away the four tongues 17 defined between the two perpendicular slots 16, so as to cause the valve 13 to open as soon as the ratio (A) of the pressure $P_1$ inside the reservoir 3 over the pressure $P_2$ inside the volume of the front chamber 6 facing the valve 13 exceeds a first value $A_1$. This opening is instantaneous and releases the ink in the form of a jet. In similar manner, closure is instantaneous once the ratio (A) of the pressures ($P_1/P_2$) becomes less than or equal to a second value $A_2$ less than or equal to $A_1$. Simultaneously with the ink being ejected, the ink is replaced by the same quantity of air rising into the reservoir 3. Such a valve is already known in applications other than writing instruments. In a specific implementation, the first value $A_1$ for the pressure ratio ($P_1/P_2$) is about 1.07 while the second valve $A_2$ is about 1.05. More precisely, since the front chamber 6 is at atmospheric pressure, the valve opens when the pressure $P_1$ is $7\times10^3$ Pascals (Pa) (equals 0.07 bar) and the valve closes when the pressure $P_1$ becomes $5\times10^3$ Pa (0.05 bar).

Figure 4:
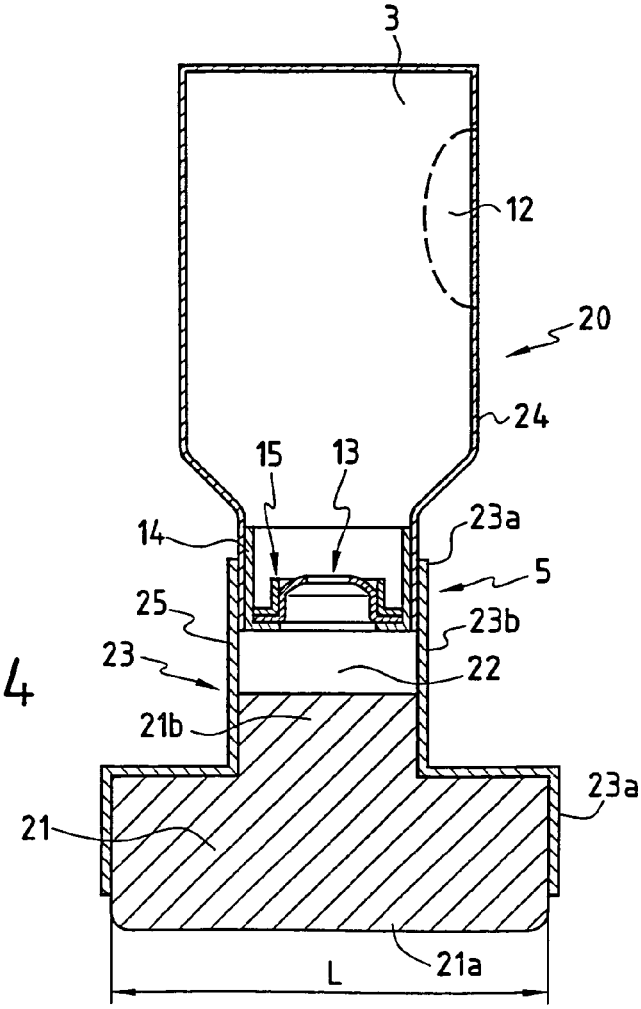
FIG. 4 is a longitudinal section view of a second embodiment of the instrument.

In the second embodiment shown in FIG. 4, the same references are used to identify the same parts as in the first embodiment. The writing instrument 20 of this second embodiment differs structurally in two essential respects. The first difference is that the writing head is constituted by the front portion 21*a* of the capillary element 21 whose configuration and size are adapted as a function of the intended application for the instrument. In the embodiment shown in FIG. 4, the instrument is a marker for professional use having a writing head of width L that may be about 30 mm.

The second difference is that the front chamber 22 is formed in a part 23 whose front portion 23*a* serves as a housing for holding the capillary element 21 in position and whose rear portion 23*b* is constituted by a transparent tube whose end 23*c* is mounted on the portion of the body 24 of the instrument 20 that acts as a reservoir 3 for the liquid ink. As can be seen clearly on examining FIG. 4, the user can look through the transparent tube 23*b* to see the jet of ink which escapes from the valve 13 during actuation of the means for pressurizing the reservoir 3, in particular the elastomer diaphragm 12. The front chamber 22 is thus strictly defined at its rear end by the valve 13, at its front end by the capillary element 21, and laterally by the transparent tube 23*b*. When the user actuates the pressurizing means, a determined quantity of ink is sprayed through the valve 13 into the front chamber 22. This quantity which preferably lies in the range 0.1 $cm^3$ to 1 $cm^3$ remains in the chamber 22 until it has been absorbed by the capillary element 21. Although the ink is sprayed instantaneously by the valve 13, its absorption by the capillary element is progressive. For a given capillary element, the time needed for the capillary element 21 to absorb the entire injected quantity of ink is a function of the quantity of ink that the capillary element 21 has already absorbed. The injected ink diffuses by capillarity throughout the volume of the capillary element 21, going away from the rear portion 21*b* thereof which is in the immediate vicinity of the front chamber 22. This rear portion 21*b* thus contains a large quantity of ink, so the newly-injected quantity finds it much more difficult to diffuse into the capillary element 21, and the quantity of ink remains in liquid form in the front chamber 22. If the user can see how quickly the injected ink is absorbed, thus discovering the extent to which the capillary element 21 is saturated, that can lead to the user either continuing or else ceasing to actuate the means for pressurizing the reservoir 3.

If necessary, the front chamber 22 communicates with ambient air by means of a hole 25 formed through the transparent tube 23*b*, preferably close to the valve 13.

The present invention is not limited to the embodiments described above as non-exhaustive examples. The elastically deformable diaphragm 12 for pressurizing the reservoir 3 may optionally be placed at the rear end of the instrument 1, 20, e.g., in the bottom of the closing plug 4. In addition, other types of pressurizing means could be implemented, for example piston type means, where the piston is not free to slide as in document EP 0 240 994, but has a stroke that is defined as a function of the unit quantity of ink that is to be sprayed on each manipulation.

The invention claimed is:

1. A liquid ink writing instrument comprising:

a body having a rear portion and a front portion, an ink reservoir at the rear portion of said body, and a front chamber communicating with ambient air;

a writing head projecting from the front portion of said body;

a capillary element contained in said front chamber for transferring ink from said reservoir to said writing head;

a valve separating said reservoir and said front chamber, said valve opening when the ratio of the pressure inside said reservoir over the pressure inside a volume of said front chamber facing said valve exceeds a first value, and reclosing instantly as soon as said ratio becomes less than or equal to a second value, said valve releasing ink in the form of a jet directed towards a rear face of said capillary element; and means for pressurizing said reservoir.

2. A writing instrument according to claim 1, wherein said first value of the ratio of the pressures is about 1.07, and said second value of said ratio is about 1.05.

3. A writing instrument according to claim 1, wherein said pressurizing means are constituted by an elastically deformable zone of said body in register with said ink reservoir.

4. A writing instrument according to claim 3, wherein said deformable zone is formed by an elastomer diaphragm tensioned over a rigid portion of said body.

5. A writing instrument according to claim 4, wherein said elastomer diaphragm is positioned over a lateral side of said body.

6. A writing instrument according to claim 3, wherein the capacity for deformation and the area of said elastically deformable zone are determined so that during unit actuation by a user, said valve releases a given quantity of ink.

7. An instrument according to claim 6, wherein said given amount of ink is in the range 0.1 $cm^3$ to 1 $cm^3$.

8. A writing instrument according to claim 1, wherein said pressurizing means are constituted by a piston placed at the rear end of said body.

9. A writing instrument according to claim 1, wherein said capillary element has an ink-receiving rear face that is concave in shape, forming a receptacle for ink.

10. A writing instrument according to claim 9, wherein said concave surface has a peripheral edge in the immediate vicinity of a peripheral edge of said valve.

11. A writing instrument according to claim 10, further comprising:

closure means suitable for hermetically sealing a rear portion of said front chamber in the event of said capillary element becoming saturated with ink; and means for reducing the inside volume of said rear portion of said front chamber.

12. A writing instrument according to claim 11, wherein said closure means and said volume reducing means are formed by a material that swells under the effect of being saturated with ink.

13. A writing instrument according to claim 1, further comprising a transparent tube having an upstream end in line with said valve and a downstream end opening out into said capillary element.

14. A writing instrument according to claim 13, wherein:

said writing head is formed by a front portion of said capillary element; and said transparent tube comprises a rear portion of a support piece for said capillary element.

15. A liquid ink writing instrument comprising:

a body having a rear portion and a front portion, an ink reservoir at the rear portion of said body, and a front chamber communicating with ambient air;

a writing head projecting from the front portion of said body;

a capillary element contained in said front chamber for transferring ink from said reservoir to said writing head;

a valve separating said reservoir and said front chamber, said valve opening when the ratio of the pressure inside said reservoir over the pressure inside a volume of said front chamber facing said valve exceeds a first value, and reclosing instantly as soon as said ratio becomes less than or equal to a second value, said valve releasing ink in the form of a jet directed towards a rear face of said capillary element; and means for pressurizing said reservoir;

wherein said valve comprises a flexible wall having shape memory and provided with slots.

* * * * *